US012529481B2

(12) United States Patent
Gode et al.

(10) Patent No.: US 12,529,481 B2
(45) Date of Patent: Jan. 20, 2026

(54) WATER FILL DRAWER WITH STRUCTURES TO PREVENT BACKFLOW OF STEAM

(71) Applicant: WHIRLPOOL CORPORATION, Benton Harbor, MI (US)

(72) Inventors: Amol Shailendra Gode, Pune (IN); Dheeraj Nandkishor Malewadkar, Pune (IN); Sachin Goverdhanrao Nilawar, Pune (IN); Vishal Jaywantrao Patil, Pune (IN); Saumil Rajeshkumar Shah, Pune (IN); Jeevan M. Yadav, Pune (IN); Bharadwaj J., Chennai (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 886 days.

(21) Appl. No.: 17/569,602

(22) Filed: Jan. 6, 2022

(65) Prior Publication Data

US 2023/0213210 A1 Jul. 6, 2023

(51) Int. Cl.

| | |
|---|---|
| ***F24C 15/32*** | (2006.01) |
| ***F24C 15/00*** | (2006.01) |
| *F24C 15/18* | (2006.01) |

(52) U.S. Cl.

CPC ..... *F24C 15/327* (2013.01); *F24C 15/003* (2013.01); *F24C 15/18* (2013.01)

(58) Field of Classification Search

CPC ..... F24C 15/003; F24C 15/18; F24C 15/327

See application file for complete search history.

(56) References Cited

U.S. PATENT DOCUMENTS

| | | | |
|---|---|---|---|
| 6,737,620 | B2 | 5/2004 | Kim |
| 7,045,745 | B2 | 5/2006 | Kim |
| 7,323,662 | B2 | 1/2008 | Cho et al. |
| 8,850,968 | B2 | 10/2014 | Seguchi et al. |
| 8,863,654 | B2 | 10/2014 | Asami et al. |
| 8,997,638 | B2 | 4/2015 | Park et al. |

(Continued)

FOREIGN PATENT DOCUMENTS

| | | | |
|---|---|---|---|
| DE | 602004007867 | T2 | 4/2008 |
| DE | 202019102498 | U1 * | 7/2019 |

(Continued)

*Primary Examiner* — Michael G Hoang
*Assistant Examiner* — Logan P Jones
(74) *Attorney, Agent, or Firm* — Price Heneveld, LLP

(57) ABSTRACT

An oven includes a water fill assembly including a holder having a receiver fixed therewith and a drawer body defining a water-receiving cavity, an opening to the water-receiving cavity, and a fill outlet from the water-receiving cavity. The drawer body defines a fluid flow path in from the opening and out through the fill outlet and includes a blocking element fixed with the drawer body. The drawer body is slideable with respect to the holder between an opened position, wherein the opening to the cavity is exposed to an environment surrounding the oven and the blocking element is spaced from the receiver, and a closed positon, wherein the drawer body is retracted into the holder and the blocking element to engage with the receiver to close the fluid flow path between the opening of the drawer body and a conduit to a water reservoir.

11 Claims, 7 Drawing Sheets

(56) References Cited

U.S. PATENT DOCUMENTS

| | | | | |
|---|---|---|---|---|
| 9,468,328 | B2 | 10/2016 | Yang et al. | |
| 9,565,963 | B2 | 2/2017 | Jeon et al. | |
| 9,565,964 | B2 | 2/2017 | Yang et al. | |
| 9,581,339 | B2 | 2/2017 | Yang et al. | |
| 9,814,343 | B2 | 11/2017 | Winkelmann et al. | |
| 10,125,978 | B2 | 11/2018 | Shibuya et al. | |
| 10,143,327 | B2 | 12/2018 | Freeman et al. | |
| 10,288,311 | B2 | 5/2019 | Cho et al. | |
| 10,830,430 | B2 | 11/2020 | Gattel et al. | |
| 10,945,444 | B2 | 3/2021 | Kim et al. | |
| 10,973,359 | B2 | 4/2021 | Donarski et al. | |
| 2012/0199015 | A1 | 8/2012 | Seguchi et al. | |
| 2013/0087107 | A1 | 4/2013 | Zhang et al. | |
| 2014/0251304 | A1 * | 9/2014 | Winkelmann ..... | A47J 36/00 126/369 |
| 2015/0253002 | A1 | 9/2015 | Shibuya et al. | |
| 2016/0061490 | A1 | 3/2016 | Cho et al. | |
| 2018/0070596 | A1 | 3/2018 | Kim et al. | |
| 2018/0070757 | A1 | 3/2018 | Lee et al. | |
| 2019/0309956 | A1 | 10/2019 | Buschman et al. | |

FOREIGN PATENT DOCUMENTS

| | | | |
|---|---|---|---|
| EP | 0132884 | A2 * | 2/1985 |
| EP | 1192888 | B1 | 5/2005 |
| EP | 1955622 | B1 | 9/2011 |
| FR | 2678359 | A1 | 12/1992 |
| FR | 2958727 | A1 | 10/2011 |
| KR | 20060114050 | A | 11/2006 |
| KR | 100715610 | B1 | 5/2007 |
| KR | 100814017 | B1 | 3/2008 |
| WO | 2018048255 | A1 | 3/2018 |
| WO | 2018146111 | A1 | 8/2018 |
| WO | 2019102407 | A1 | 5/2019 |

* cited by examiner

WATER FILL DRAWER WITH STRUCTURES TO PREVENT BACKFLOW OF STEAM

BACKGROUND OF THE DISCLOSURE

The present disclosure generally relates to a water reservoir assembly for an oven with steam cooking functionality, and more specifically, to a water reservoir assembly that reduces or eliminates the transmission of oven generated steam through the water reservoir assembly and into the external environment.

Some ovens have the capability to cook a food item in the presence of steam. For example, some ovens include a reservoir that the user can fill with liquid water (hereinafter, liquid water is referred to simply as "water" while water in a predominantly gaseous state is referred to as "steam"). The oven then transforms the water from the reservoir into steam to deliver to an environment around the food item during cooking thereof. However, there is a problem in that steam and water tend to escape from the reservoir during use of the oven, including when the user adds water to the reservoir.

SUMMARY OF THE DISCLOSURE

According to one aspect of the present disclosure, an oven includes a cooking chamber, a cabinet at least partially surrounding the cooking chamber, a water reservoir having a reservoir inlet and a reservoir outlet, the oven being configured to extract water from the water reservoir via the reservoir outlet to supply steam to the cooking chamber, and a conduit defining a portion of a fluid flow path into the reservoir inlet. The oven further includes a water fill assembly including a holder having a receiver fixed therewith and a drawer body defining a water-receiving cavity, an opening to the water-receiving cavity, and a fill outlet from the water-receiving cavity. The drawer body defines a fluid flow path in from the opening and out through the fill outlet and includes a blocking element fixed with the drawer body. The drawer body is slideable with respect to the holder between an opened position, wherein the opening to the cavity is exposed to an environment surrounding the oven and the blocking element is spaced from the receiver, and a closed position, wherein the drawer body is retracted into the holder and the blocking element to engage with the receiver to close the fluid flow path between the opening of the drawer body and the conduit.

According to another aspect of the present disclosure, an oven includes a cooking chamber, a cabinet at least partially surrounding the cooking chamber, a water reservoir having a reservoir inlet and a reservoir outlet, the oven being configured to extract water from the water reservoir via the reservoir outlet to supply steam to the cooking chamber, and a conduit defining a portion of a fluid flow path into the reservoir inlet. The oven can further include a water fill assembly including a holder having a notch on an end of a flange fixed with the holder, the flange extending from an upper wall of the holder, and a drawer body defining a water-receiving cavity, an opening to the water-receiving cavity, and a fill outlet from the water-receiving cavity. The drawer body defines a fluid flow path in from the opening and out through the fill outlet and includes a ledge extending vertically from a bottom surface of the drawer body within the water-receiving cavity. The drawer body is slideable with respect to the holder between an opened position, wherein the opening to the cavity is exposed to an environment surrounding the oven and the ledge is spaced from the notch, and a closed position, wherein the drawer body is retracted into the holder and the ledge is in contact with the notch to close the fluid flow path between the opening of the drawer body and the conduit.

According to yet another aspect of the present disclosure, an oven includes a cooking chamber, a cabinet at least partially surrounding the cooking chamber, a water reservoir having a reservoir inlet and a reservoir outlet, the oven being configured to extract water from the water reservoir via the reservoir outlet to supply steam to the cooking chamber, and a conduit defining a portion of a fluid flow path into the reservoir inlet. The oven further includes a water fill assembly having a holder, a drawer body defining a water-receiving cavity, an opening to the water-receiving cavity, and a fill outlet from the water-receiving cavity. The drawer body defines a fluid flow path in from the opening and out through the fill outlet and is slideable with respect to the holder between an opened position, wherein the opening to the cavity is exposed to an environment surrounding the oven and a closed position, wherein the drawer body is retracted into the holder. The water fill assembly also has a cylinder connected between the fill outlet and the conduit, having a first end, and fixed with respect to the holder and a piston fixed with respect to the drawer and movable within the cylinder away from the first end when the drawer body is in the opened position and into engagement with the first end of the cylinder when the drawer body is in the closed position to close the fluid flow path between the opening of the drawer body and the conduit.

These and other features, advantages, and objects of the present disclosure will be further understood and appreciated by those skilled in the art by reference to the following specification, claims, and appended drawings.

Figure 1:
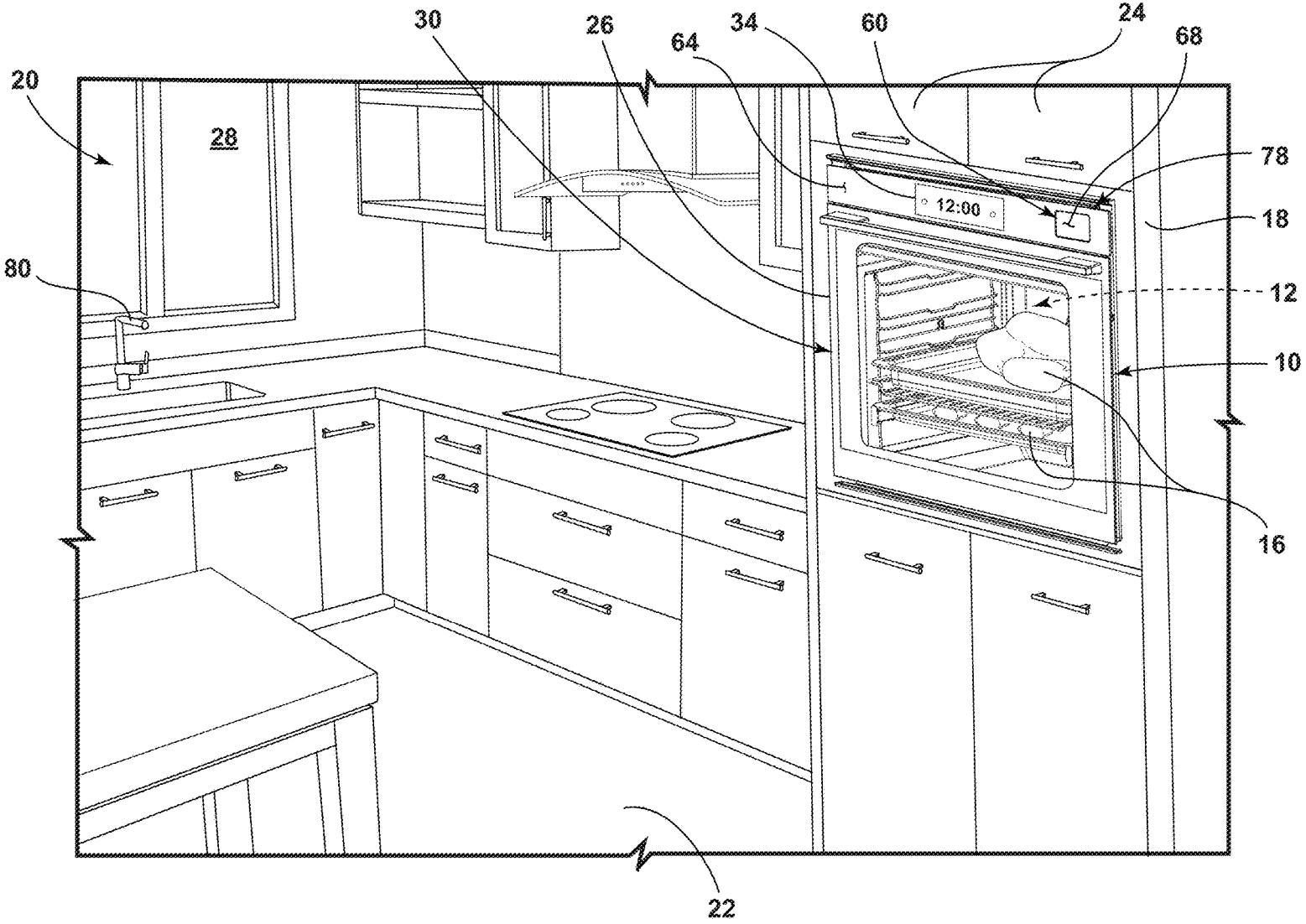
FIG. 1 is a view of a kitchen that includes an oven with a water storage assembly of the present disclosure in a water supply state capable of providing water to a steam generation system of the oven to supply steam into a cooking chamber of the oven while cooking one or more food items disposed therein.

The components in the figures are not necessarily to scale, emphasis instead being placed upon illustrating the principles described herein.

DETAILED DESCRIPTION

The present illustrated embodiments reside primarily in combinations of method steps and apparatus components related to an oven. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-10, reference numeral 10 generally designates an oven that includes a cooking chamber 12, a cabinet 14 at least partially surrounding the cooking chamber, a water reservoir 40 having a reservoir inlet 42 and a reservoir outlet 43. The oven 10 is configured to extract water from the water reservoir 40 via the reservoir outlet 43 to supply steam to the cooking chamber 12. A conduit 54 defines a portion of a fluid flow path 52 into the reservoir inlet 42. A water fill assembly 44 includes a holder 70 having a receiver 56 fixed therewith and a drawer body 66 defining a water-receiving cavity 50, an opening 48 to the water-receiving cavity 50, and a fill outlet 46 from the water-receiving cavity 50. The drawer body 66 defines the fluid flow path 52 in from the opening 48 and out through the fill outlet 46 and includes a blocking element 72 fixed with the drawer body 66. The drawer body 66 is slideable with respect to the holder 70 between an opened position P1 (FIG. 4), wherein the opening 48 to the cavity 50 is exposed to an environment 28 surrounding the oven 10 and the blocking element 72 is spaced from the receiver 56, and a closed position P2 (FIG. 1), wherein the drawer body 66 is retracted into the holder 70 and the blocking element 72 is engaged with the receiver 56 to close the fluid flow path 52 between the opening 48 of the drawer body 66 and the conduit 54.

Figure 2:
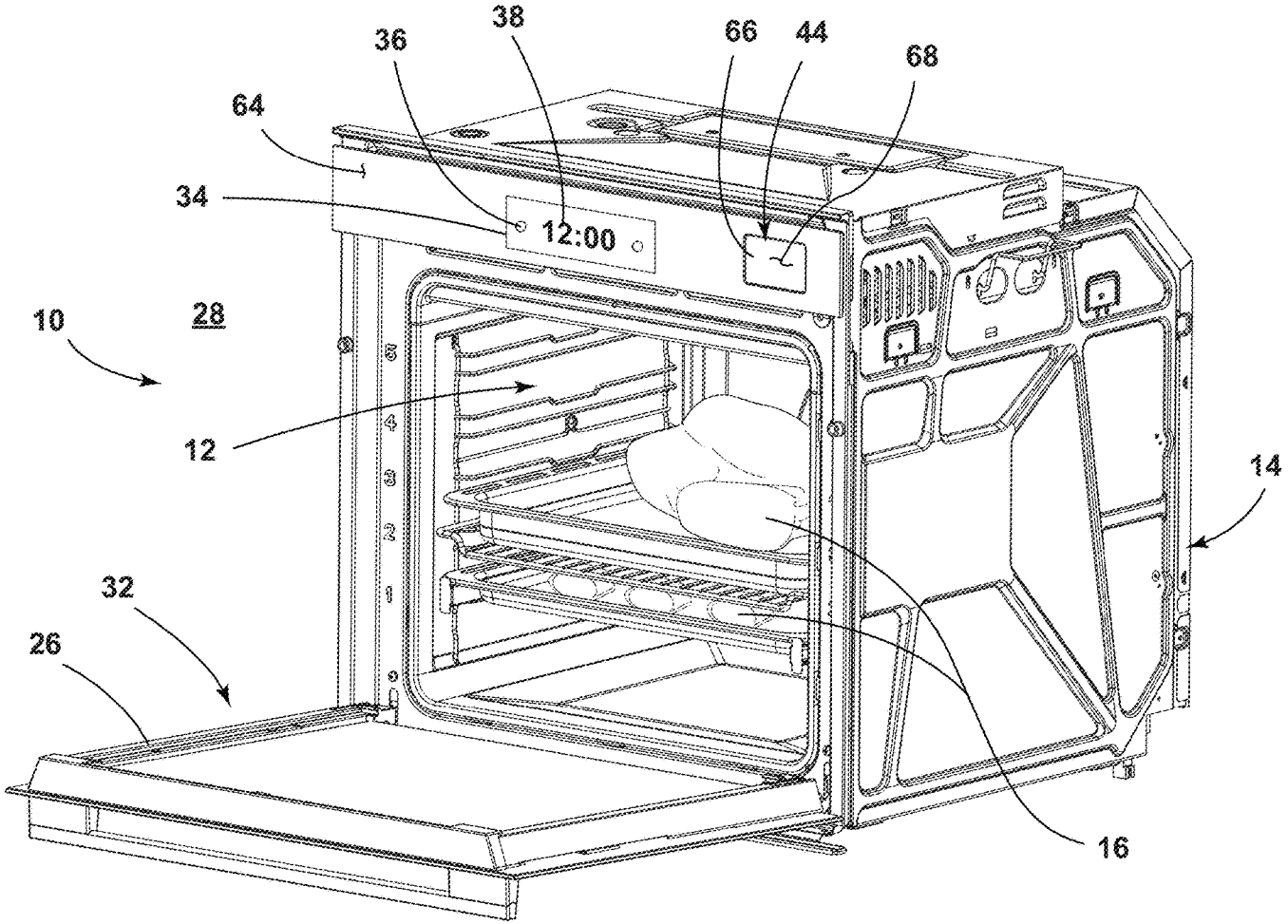
FIG. 2 is a perspective view of the oven of FIG. 1 with the door in an open position that allows access to the cooking chamber from an external environment.
Figure 3:
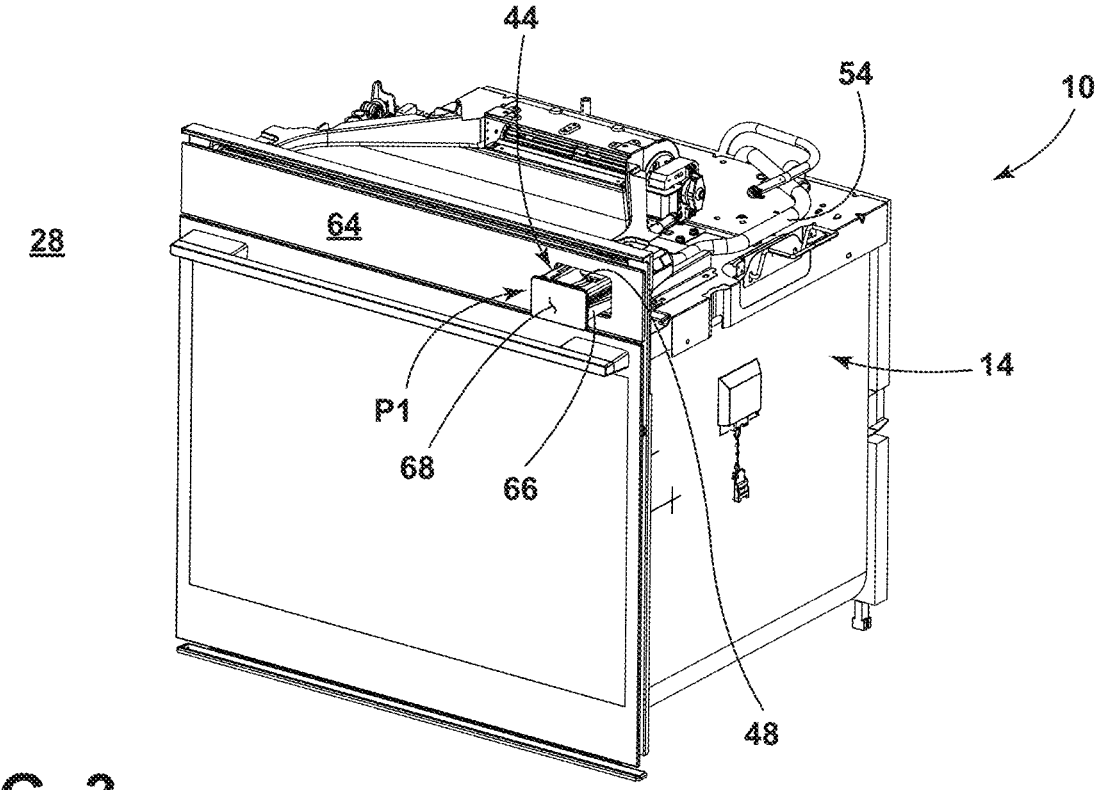
FIG. 3 is a perspective view of the oven of FIG. 1, illustrating the water storage assembly in a fillable state, where the inlet is open to the external environment allowing a user to deposit water into a fill assembly through an inlet.
Figure 4:
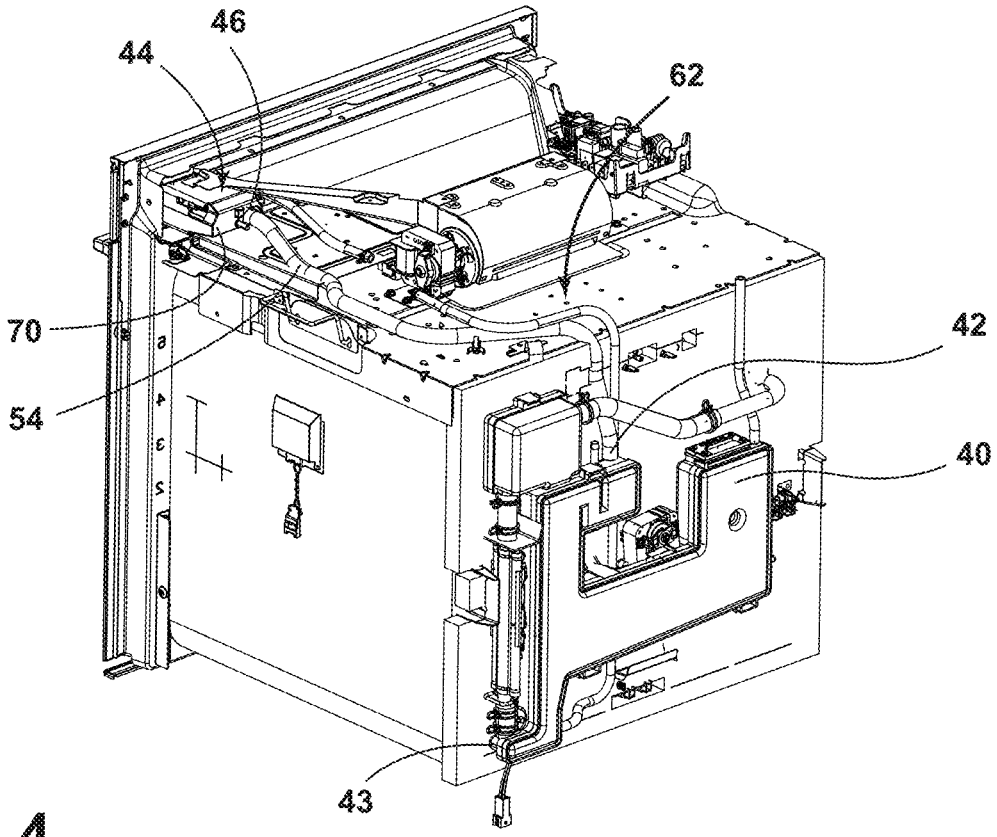
FIG. 4 is a back perspective view of the oven of FIG. 1, showing the water storage assembly of FIG. 1.

Referring to FIGS. 1 and 2, the oven 10 is configured to cook one or more food items 16 that are disposed within the cooking chamber 12, such as with a heating element that increases a temperature of the one or more food items 16 disposed within the cooking chamber 12 via electrical resistance, microwave emissions, or the combustion of a gas (e.g., natural gas, propane, butane, and so on). The oven 10 may be considered to be a "wall oven," as illustrated at FIG. 1, where the cabinet 14 of the oven 10 is mostly hidden behind paneling 18 or other structural features of a kitchen 20 or another room where the oven 10 is disposed. The oven 10 may be elevated in such instances from a floor 22 of the kitchen 20 or another room where the oven 10 is disposed. In other implementations, the oven 10 is part of a "range" unit and further includes a cooktop (not illustrated) disposed above the cooking chamber 12. In such implementations, the oven 10 (i) may be of the "slide-in" variety where cabinetry 24, paneling 18, or other structural features within the kitchen 20 (or other room) generally hides the cabinet 14 of the oven 10, or (ii) may be of the "freestanding" variety where cabinetry 24, paneling 18, or other structural features of the kitchen 20 (or other room) do not hide the cabinet 14 of the oven 10 but, rather, a covering (not illustrated) covers the cabinet 14 of the oven 10.

The oven 10 further includes a door 26 to selectively deny or allow access to the cooking chamber 12 from the external environment 28. The door 26 includes a closed position 30 (FIG. 1) where the door 26 denies access to the cooking chamber 12 from the external environment 28. In addition, the door 26 includes an opened position 32 (see, e.g., FIG. 2) where the door 26 allows access to the cooking chamber 12 from the external environment 28. The door 26 is able to move to, from, and between the closed position 30 and the opened position 32. The door 26 may be in the closed position 30 while the oven 10 is cooking the one or more food items 16, so that the cooking chamber 12 better retains heat that the oven 10 generates. A user of the oven 10 may transition the door 26 from the closed position 30 to the opened position 32 to place the one or more food items 16 into the cooking chamber 12 or to remove the one or more food items 16 from the cooking chamber 12, such as after the oven 10 has cooked the one or more food items 16.

In certain implementations, the oven 10 further include a human-machine interface 34. The human-machine interface 34 may include buttons 36, a touch screen display 38, among other items that allow the user to control operation of the oven 10. The human-machine interface 34 is usable from the external environment 28, and, in one configuration, is disposed above the door 26.

Referring now additionally to FIGS. 3-9, the water reservoir 40 is for use with a steam cooking function of the oven 10. The water reservoir 40 includes the inlet 42 that receives water from the fill assembly 44 via the conduit 54 and the outlet 46. The inlet 42 is configured to accept water W for storage in the reservoir 40 from the fill assembly 44. For example, the fill assembly 44 is disposed elevationally above the reservoir 40 so that gravity forces the water W to flow through the conduit 54 into the reservoir 40. The user deposits water W through the opening 48 of the water fill assembly 44 and the water W enters the cavity 50 before flowing out through the outlet 46 and the check valve 54 to enter the conduit 54. The reservoir 40 stores the water W until the oven 10 extracts the water W from the reservoir 40 to generate steam therefrom for a steam cooking function. The oven 10 draws water W from the reservoir 40 through the reservoir outlet 43.

In the illustrated example, the fill outlet 46 is disposed through the back wall 58 that defines a portion of the water-receiving cavity 50. In other implementations, the outlet 46 may be disposed through a bottom surface 60 that defines the water-receiving cavity 50. The outlet 46 is configured to allow the fluid flow path 52 to exit the water-receiving cavity 50 to flow into the conduit 54 for storage in the reservoir 40 until needed by the steam generation system of the oven 10, which is configured to transform the water W into steam for using during a steam cooking function. Steam generation systems for ovens are known in the art, and include any system that heats the water W into steam, which is then introduced into the cooking chamber 12 during cooking of the one or more food items 16. An example of the steam generation system is set forth in U.S. Pat. App. Pub. No. 2019/0309956 (published Oct. 10, 2019 and assigned to Whirlpool Corporation), the entire contents of which are incorporated by reference herein.

In some aspects, it may be possible for steam generated within the oven 10 to flow from the boiler associated with steam generation back into the reservoir 40. In the above-described arrangement, wherein gravity is used to promote the flow of water W from the fill assembly 44, along fluid flow path 52, through the conduit 54 and into the reservoir 40, the fill assembly 44 is positioned vertically above the reservoir 40 to facilitate such downstream flow. This arrangement, however, may facilitate the upward escape of steam in a backflow (i.e., upstream) direction against the intended flow path 52 such that steam S may tend to flow upward through the conduit 54 and toward the fill assembly 44. In this manner, when the blocking element 72 is spaced from the receiver 56, the fluid flow path 52 is open between the drawer body 66 and the conduit 54 to allow an inflow of water W from the opening 48 of the water-receiving cavity 50 to the reservoir 40. On the other hand, when the blocking element 72 is engaged with the receiver 56, the fluid flow path 52 between the opening 48 of the drawer body 66 and the conduit 54 is closed to obstruct a backflow of steam from the reservoir 40 to the opening 48 of the drawer body 66. To accomplish such movement and corresponding positioning, the blocking element 72 can be rigidly fixed with the drawer body 66 to move with the drawer body 66 between the closed position P2 and the opened, or fill, position P1.

In a further aspect of the disclosure, the combination of the water fill assembly 44 and reservoir 40 discussed herein can be a component of a water storage assembly 62 useable in connection with the oven 10 described herein and configured for to supply steam S to the cooking chamber 12 thereof. In general, the assembly 62 includes the interacting receiver 56 and blocking element 72 described herein wherein the blocking element 72 closes against the receiver 56 to prevent a backflow against the fluid path 52 and into the water fill assembly 44 and opens away from the receiver 56 to allow an infill of water from the water-receiving cavity 50 through the conduit 54 connecting the fill assembly 44 with the water reservoir inlet 42 downstream of the fill outlet 46. It will be appreciated that such a water storage assembly 62 may be adapted for use with other appliances that store water for the use in generating and supplying steam. In aspects, the water storage assembly 62 is described according to specific adaptations for use with the oven 10 described herein. In one such aspect, the oven 10 may further include a front face 64, and the water fill assembly 44 may include the drawer body 66 having an outer surface 68 and defining the opening 48, the water-receiving cavity 50, and the fill outlet 46. The drawer body 66 is movably mounted in the holder 70 so as to be slidable with respect to the holder 70 and the rest of the oven 10. The fill outlet 46 is defined on the drawer body 66, as shown. The drawer body 66, in particular, is slideable with respect to the holder 70 between the opened position P1 (FIG. 1), wherein the opening 48 to the cavity 50 is exposed to the environment 28 surrounding the oven 10, and the closed position P2 (FIG. 4), wherein the drawer body 66 is retracted into the holder 70 and the outer surface 68 of the drawer body 66 is generally coplanar with the front face 64 of the oven 10. In this arrangement, the drawer body 66 is pulled outward into the opened position P1 for the user to pour water through the opening 48 and into the cavity 50, wherein the water moves along the flow path 52 to fill the reservoir 40 (at least partially), as discussed above. The drawer body 66 is then pushed back into the closed position P2 for use of the oven 10.

The above-described interacting receiver 56 and blocking element 72 are present and configured to allow the above-described movement of water W along the flow path 52, while preventing the backflow of steam S from conduit 54 from moving through the fill outlet 46 and into the water-receiving cavity 50, where such steam S may otherwise collect until a sufficient pressure is built up that may cause the steam S to escape the fill assembly 44 and enter the external environment 28. More particularly, as shown in one implementation in FIGS. 5-7, the blocking element 72 can be defined along a ledge 74 that extends vertically from the bottom surface 60 of the drawer body 66 within the water-receiving cavity 50. The receiver 56 is defined in a notch 76 on an end 77 of a flange 78 that extends from an upper wall 80 of the holder into the water-receiving cavity 50 such that the ledge 74 moves into contact with the notch 76 when the drawer body 66 is in the closed position P2. In this manner, the drawer body 66 is slideable with respect to the holder 70 between the opened position P1 (FIG. 6), wherein the ledge 74 is spaced from the notch 76, and the closed position P2, wherein the drawer body 66 is retracted into the holder 70 and the ledge 74 is in contact with the notch 76 to close the fluid flow path 52 between the opening 48 of the drawer body 66 and the conduit 54 (FIG. 7). As further shown in FIG. 7, the engagement between the ledge 74 and the notch 76 is such that the fluid flow path 52 within a rearward portion of the cavity 50 that includes the back wall 58 and the fill outlet 46 is generally blocked by the flange 78 such that the fill outlet 46 is generally cut off from the opening 48, as shown in FIG. 7.

Figure 6:
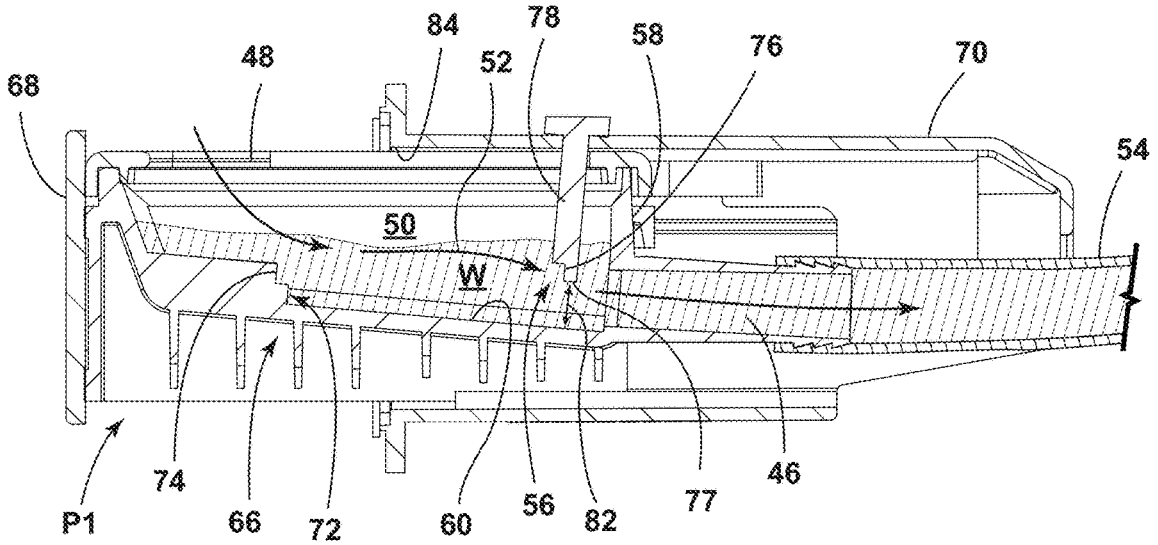
FIG. 6 is a cross-section view of the drawer body in an open state, allowing the infill of water therethrough.
Figure 7:
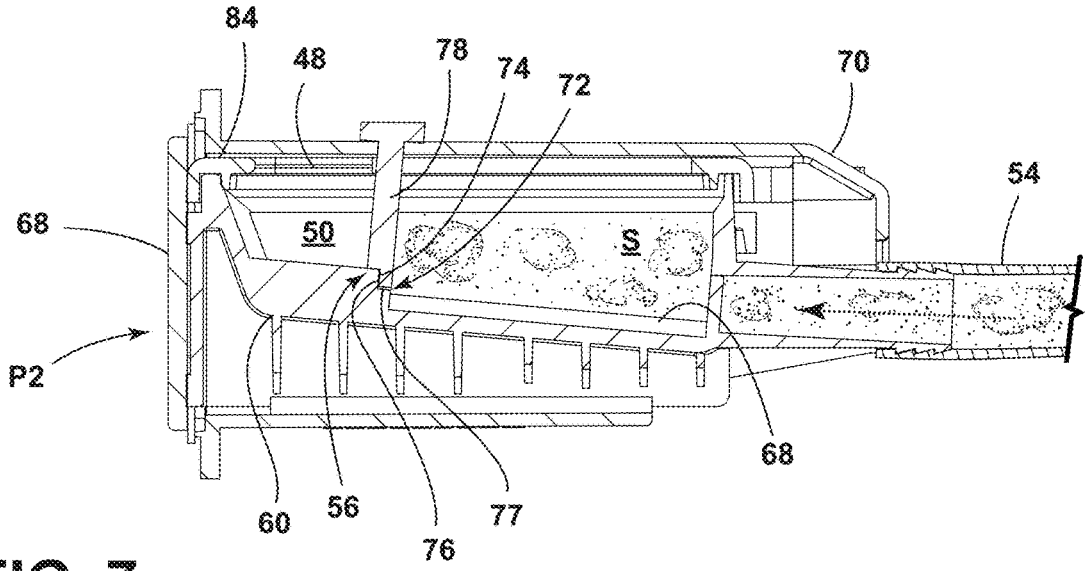
FIG. 7 is a cross-section view of the drawer body in a closed state, preventing the backflow of steam therethrough.

As further shown in FIGS. 6 and 7, the ledge 74 can be spaced apart from the bottom surface 60 of the water-receiving cavity 50 such that the end 77 of the flange 78 aligns with the notch 76 throughout the movement of the drawer body 66 relative to the holder 70 between the closed position P2 and the opened position P1. In this manner, the ledge 74 approaches the notch 76 along a horizontal, linear path that corresponds with the expected movement of the drawer body 66 relative to the oven 10. The position of the ledge 74 above the bottom surface 60 allows for clearance between the end 77 of the flange 78 and the bottom surface 60 when the drawer body 66 is in the opened position P1 so that there is a space for water W to flow out from the cavity 50 and into the fill outlet 46 at an acceptable rate by allowing the flow path 52 to extend between the end 77 of the flange 78 and the bottom surface 60 of the water-receiving cavity 50 when the drawer body 66 is in the opened position P1. In one aspect, the bottom surface 60 of the water-receiving cavity 50 can be sloped downwardly away from the ledge 74 to increase a distance 82 between the bottom surface 60 and the end 77 of the flange 78 when the drawer body 66 is in the opened position P1 compared to the closed position P2, as shown in FIG. 6. In this manner, the distance 82 is greater than the distance between the ledge 74 and the bottom surface 60 of the cavity 50. This distance 82 provides an increased area of the opening 48 between the end 77 of the flange 78 and the bottom surface 60 of the cavity 50 across the width of the cavity 50 to allow additional flow of water out of the cavity 50. In one aspect, this area is greater than an area of the fill outlet 46 such that the presence of the flange 78 does not affect the flow of water W out of the cavity 50.

Figure 5:
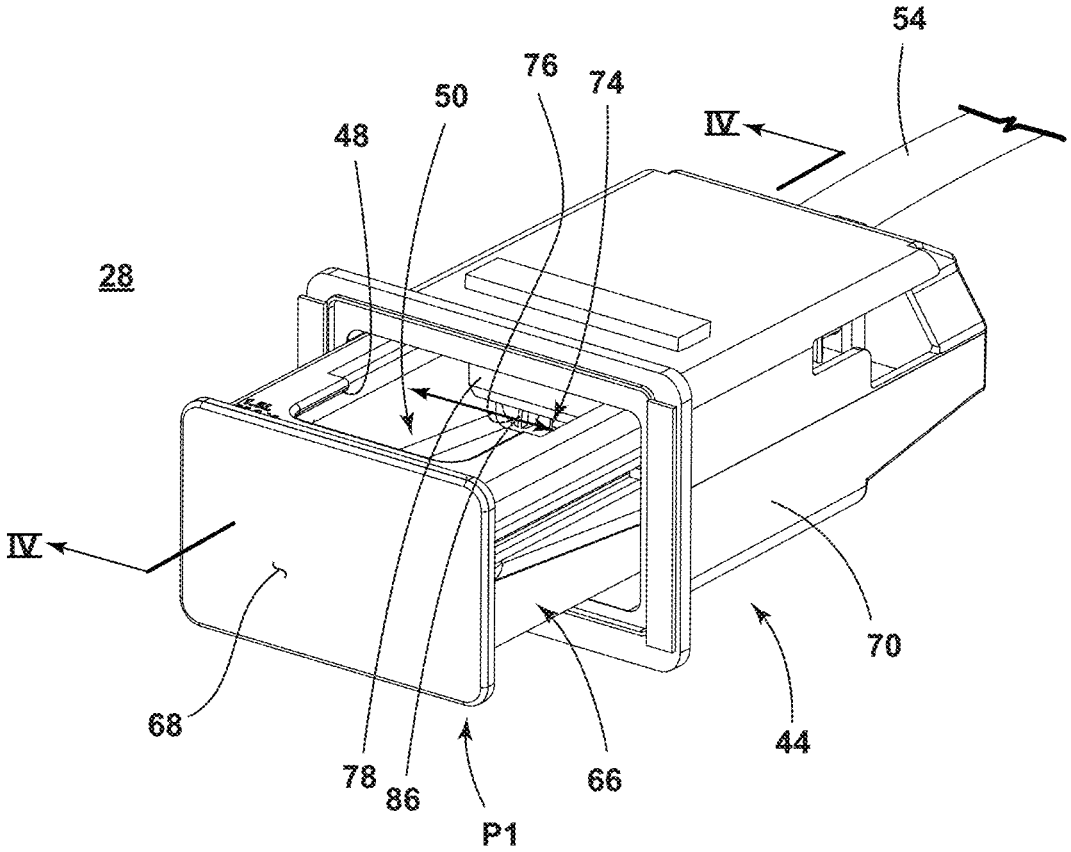
FIG. 5 is a detail view of a portion of the water storage assembly showing interacting features between a drawer body and a holder for restricting an upstream flow of steam back into the fill assembly.

In general, the flange 78 is fixed with the holder 70 and extends downward from the upper wall 80 thereof in a position to allow the full intended range of movement for the drawer body 66 relative to the holder 70. In this manner, the back wall 58 of the drawer body 66 can be positioned adjacent the flange 78 when the drawer body 66 is in the opened position P1. As shown, the flange 78 can be positioned rearward of the open end 84 of the holder 70 such that the flange 78 is less visible from view than it would be if positioned toward the open end 84, and to allow for increased distance 82 with respect to the bottom surface 60 of the cavity 50, as it slopes downward toward the back wall 58, the cavity 50 extending rearward of the open end 84 of the holder 70 when the drawer body 66 is in the opened position P1. As shown in FIG. 5, the flange 78 extends across a width 86 of the cavity 50 to maintain the steam-blocking seal between the flange 78 and the drawer body 66, including between the ledge 74 and the notch 76 when the drawer body 66 is in the closed position P2. Notably, the seal between the flange 78 and the drawer body 66 does not have to be hermetic or air-tight to sufficiently restrict the flow of steam S out of the opening 48 of the drawer body 66, but can be achieved by contact between the flange 78 and the relevant portions of the drawer body 66 that permits the desired movement of the drawer body 66 relative to the holder 70.

Figure 8:
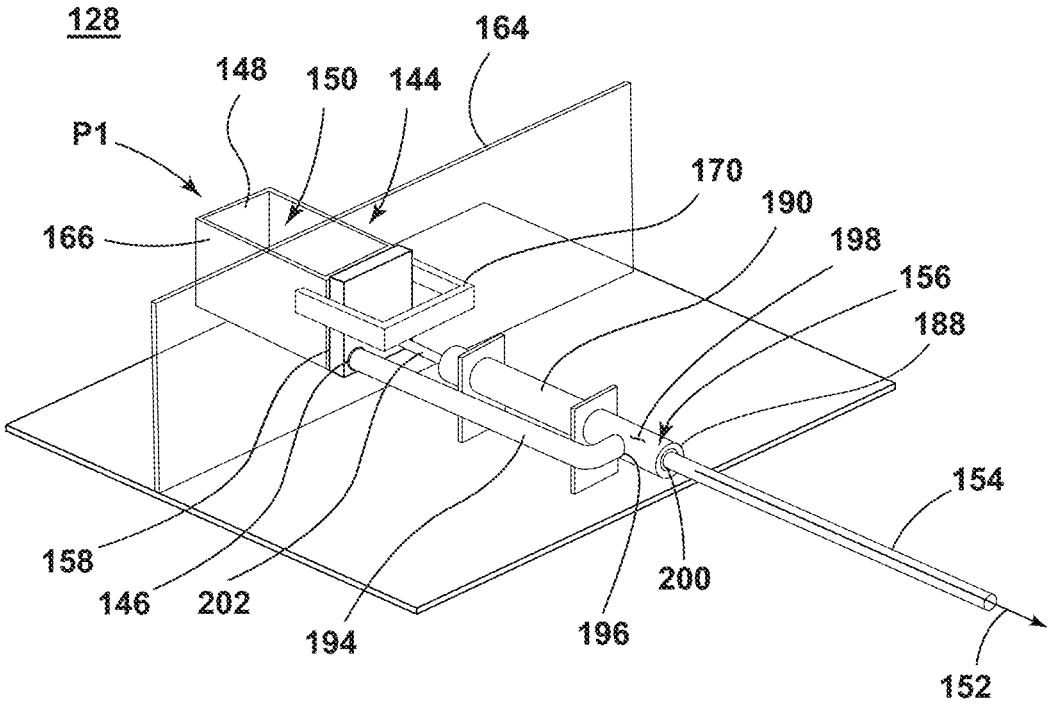
FIG. 8 is a detail view of an alternative portion of the water storage assembly showing alternative interacting features between a drawer body and a holder for restricting an upstream flow of steam back into the fill assembly.
Figure 9:
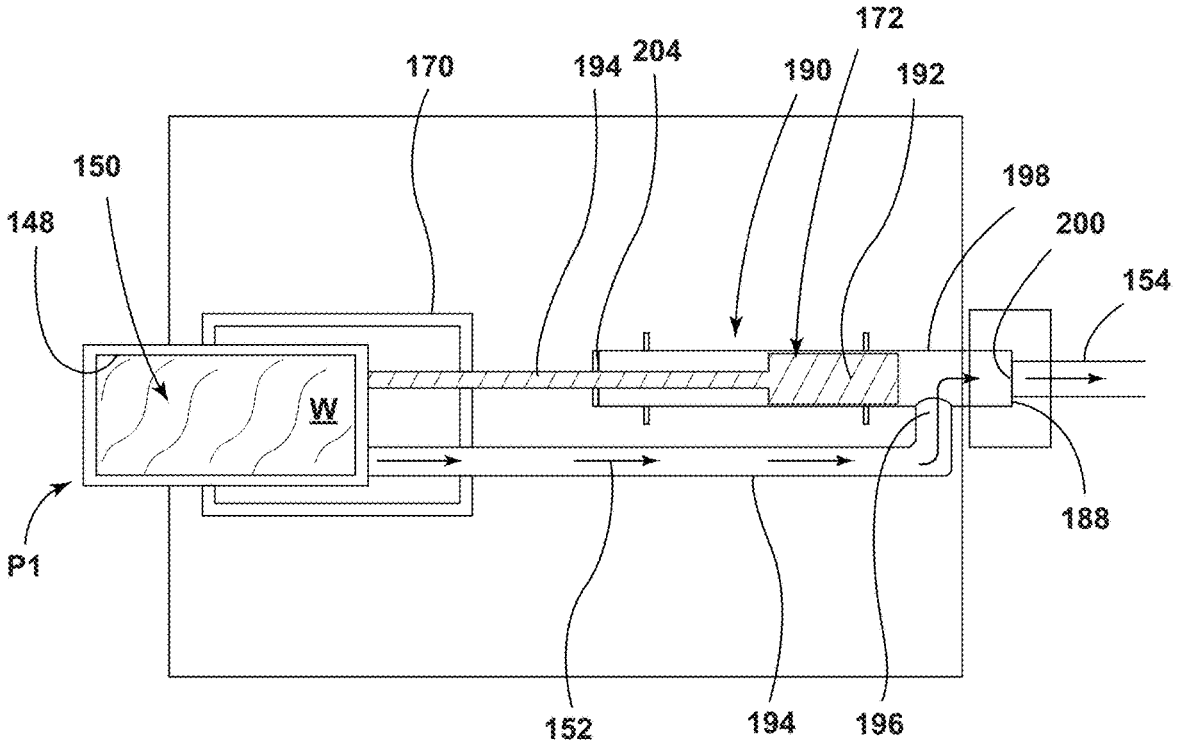
FIG. 9 is a cross-section view of the alternative implementation of interacting features in an open state, allowing the infill of water therethrough.
Figure 10:
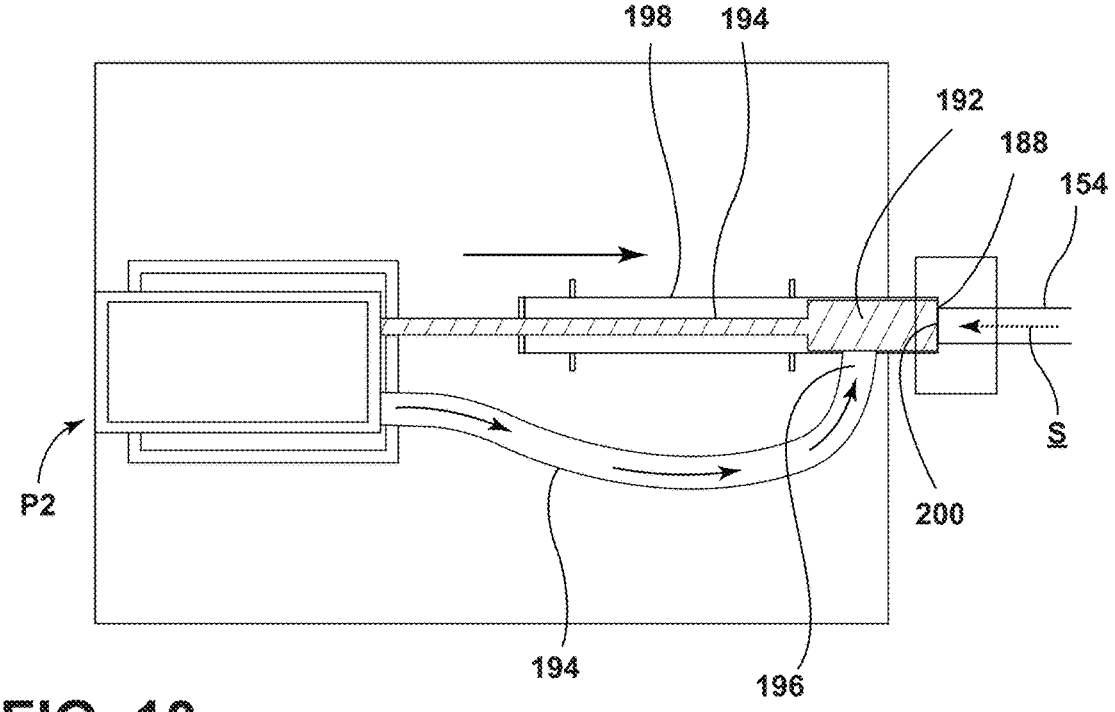
FIG. 10 is a cross-section view of the interacting features of FIG. 8 in a closed state, preventing the backflow of steam therethrough.

In an alternative implementation shown in FIGS. 8-10, wherein similar features to those discussed above are given similar numbering increased by 100, the receiver 156 can be defined within a first end 188 of a cylinder 190 connected between the fill outlet 146 and the conduit 154 and fixed with respect to the holder 170. In this implementation, the blocking element 172 can be a piston 192 fixed with respect to the drawer body 166 and movable within the cylinder 190 away from the first end 188 when the drawer body 166 is in the opened position P1 and into engagement with the first end 188 when the drawer body 166 is in the closed position P2. In this manner, a variation of the above-described oven 10 can include a water fill assembly 144 having a holder 170, a drawer body 166 defining a water-receiving cavity 150, an opening 148 to the water receiving cavity 150, and a fill outlet 146 from the water-receiving cavity 150. The drawer body 166 defines a fluid flow path 152 in from the opening 148 and out through the fill outlet 146 and is slideable with respect to the holder 170 between an opened position P1, wherein the opening 148 to the cavity 150 is exposed to the environment 128 surrounding the oven 10 and a closed position P2, wherein the drawer body 166 is retracted into the holder 170. The cylinder 190 is connected between the fill outlet 146 and the conduit 154 and is fixed with respect to the holder 170 and the piston 192 is fixed with respect to the drawer body 166 and is movable within the cylinder 190 away from the first end 188 when the drawer body 166 is in the fill (opened) position P1 and into the first end 188 of the cylinder 190 when the drawer body 166 is in the closed position P2 to close the fluid flow path 152 between the fill opening 148 and the conduit 154. As with the arrangement described above, the positioning of the piston 192 within the first end 188 of the cylinder 190 blocks any backflow of steam S in the conduit 154 from entering the cavity 150 and potentially escaping to the environment 128 through the opening 148 of the drawer body 166.

The cylinder 190 can be connected with the fill outlet 146 by a flexible tube 194 coupled with a first opening 196 along a side wall 198 of the cylinder 190 adjacent the first end 188 thereof. The cylinder 190 can be connected with the conduit 154 through a second opening 200 in the first end 188 of the cylinder 190. In this arrangement, the piston 192 can cover at least one of the first opening 196 and the second opening 200 when the drawer body 166 is in the closed position P2 such that the flow path 152 is blocked from a backflow of steam S at least one of entering the cylinder 190 through the second opening 200 or exiting the cylinder 190 through the first opening 196. In one aspect, the piston 192 can be sized, and the first and second openings 196 and 200 relatively positioned, such that the piston 192 obscures both openings 196 and 200 when the piston 192 is engaged with the end 188 of the cylinder 190 (due to the drawer body 166 being in the closed position P2). In this arrangement, the piston 192 is spaced apart from the first opening 196 and the second opening 200 when the drawer body 166 is in the opened position P1 such that a portion of the fluid flow path 152 extends through the end 188 of the cylinder 190 between the first and second openings 196 and 200. As shown, the piston 192 can be fixed with the drawer body 166 by a stem 202 that extends from the back wall 158 of the drawer body 166 through a second end 204 of the cylinder 190 opposite the first end 188. The stem 202 can be generally rigid to effect the desired movement of the piston 192 within the cylinder 190, with the flexible tube 194 bending to accommodate the movement of the drawer body 166 with respect to the fixed body of the cylinder 190.

The invention disclosed herein is further summarized in the following paragraphs and is further characterized by combinations of any and all of the various aspects described therein.

According to another aspect of the present disclosure, an oven includes a cooking chamber, a cabinet at least partially surrounding the cooking chamber, a water reservoir having a reservoir inlet and a reservoir outlet, the oven being configured to extract water from the water reservoir via the reservoir outlet to supply steam to the cooking chamber, and a conduit defining a portion of a fluid flow path into the reservoir inlet. The oven further includes a water fill assembly including a holder having a receiver fixed therewith and a drawer body defining a water-receiving cavity, an opening to the water-receiving cavity, and a fill outlet from the water-receiving cavity. The drawer body defines a fluid flow path in from the opening and out through the fill outlet and includes a blocking element fixed with the drawer body. The drawer body is slideable with respect to the holder between an opened position, wherein the opening to the cavity is exposed to an environment surrounding the oven and the blocking element is spaced from the receiver, and a closed position, wherein the drawer body is retracted into the holder and the blocking element to engage with the receiver to close the fluid flow path between the opening of the drawer body and the conduit.

When the blocking element is spaced from the receiver, the fluid flow path is open between the drawer body and the conduit to allow an inflow of water from the opening of the cavity to the reservoir, and when the blocking element is engaged with the receiver to close the fluid flow path between the opening of the drawer body and the conduit a backflow of steam from the reservoir to the opening of the drawer body is obstructed.

The blocking element can be rigidly fixed with the drawer body to move with the drawer body between the closed position and the opened position.

The oven can further include a front face, and the drawer body has an outer surface that is generally coplanar with the front face of the oven when the drawer body is in the closed position.

The blocking element can be defined along a ledge that extends vertically from a bottom surface of the drawer body within the water-receiving cavity.

The receiver can be defined in a notch on an end of a flange that extends from an upper wall of the holder into the water-receiving cavity, the ledge moving into contact with the notch when the drawer body is in the closed position.

The ledge can be spaced apart from the bottom surface of the water-receiving cavity such that the end of the flange aligns with the notch in a position spaced from the bottom surface of the water-receiving cavity to allow the flow path to extend between the end of the flange and the bottom surface of the water-receiving cavity when the drawer body is in the opened position.

The bottom surface of the water-receiving cavity can be sloped downwardly away from the ledge to increase a distance between the bottom surface and the end of the flange when the drawer body is in the opened position compared to the closed position.

A back wall of the drawer body can be positioned adjacent the flange when the drawer body is in the opened position.

The receiver can be defined within a first end of a cylinder connected between the fill outlet and the conduit and fixed with respect to the holder, and the blocking element can be a piston fixed with respect to the drawer body and movable within the cylinder away from the first end when the drawer body in the opened position and into engagement with the first end when the drawer body is in the closed position.

The cylinder can be connected with the fill outlet by a flexible tube coupled with a first opening along a side wall of the cylinder adjacent the first end, the cylinder can be connected with the conduit through a second opening in the first end.

The piston can cover at least one of the first opening and the second opening when the drawer body is in the closed position.

The piston can be spaced apart from the first opening and the second opening when the drawer body is in the opened position such that a portion of the fluid flow path extends through the first end of the cylinder between the first and second openings.

The piston can be fixed with the drawer body by a stem that extends from a back wall of the drawer body through a second end of the cylinder opposite the first end.

According to yet another aspect, an oven includes a cooking chamber, a cabinet at least partially surrounding the cooking chamber, a water reservoir having a reservoir inlet and a reservoir outlet, the oven being configured to extract water from the water reservoir via the reservoir outlet to supply steam to the cooking chamber, and a conduit defining a portion of a fluid flow path into the reservoir inlet. The oven can further include a water fill assembly including a holder having a notch on an end of a flange fixed with the holder, the flange extending from an upper wall of the holder, and a drawer body defining a water-receiving cavity, an opening to the water-receiving cavity, and a fill outlet from the water-receiving cavity. The drawer body defines a fluid flow path in from the opening and out through the fill outlet and includes a ledge extending vertically from a bottom surface of the drawer body within the water-receiving cavity. The drawer body is slideable with respect to the holder between an opened position, wherein the opening to the cavity is exposed to an environment surrounding the oven and the ledge is spaced from the notch, and a closed position, wherein the drawer body is retracted into the holder and the ledge is in contact with the notch to close the fluid flow path between the opening of the drawer body and the conduit.

The flange can extend vertically into the water-receiving cavity such that the ledge moves into contact with the notch when the drawer is in the closed position.

The ledge can be spaced apart from the bottom surface of the water-receiving cavity such that the end of the flange aligns with the notch in a position spaced from the bottom surface of the water-receiving cavity to allow the flow path to extend between the end of the flange and the bottom surface of the water-receiving cavity when the drawer body is in the opened position.

According to yet another aspect, an oven includes a cooking chamber, a cabinet at least partially surrounding the cooking chamber, a water reservoir having a reservoir inlet and a reservoir outlet, the oven being configured to extract water from the water reservoir via the reservoir outlet to supply steam to the cooking chamber, and a conduit defining a portion of a fluid flow path into the reservoir inlet. The oven further includes a water fill assembly having a holder, a drawer body defining a water-receiving cavity, an opening to the water-receiving cavity, and a fill outlet from the water-receiving cavity. The drawer body defines a fluid flow path in from the opening and out through the fill outlet and is slideable with respect to the holder between an opened position, wherein the opening to the cavity is exposed to an environment surrounding the oven and a closed position, wherein the drawer body is retracted into the holder. The water fill assembly also has a cylinder connected between the fill outlet and the conduit, having a first end, and fixed with respect to the holder and a piston fixed with respect to the drawer and movable within the cylinder away from the first end when the drawer body in the opened position and into engagement with the first end of the cylinder when the drawer body is in the closed position to close the fluid flow path between the opening of the drawer body and the conduit.

The cylinder can be connected with the fill outlet by a flexible tube coupled with a first opening along a side wall of the cylinder adjacent the first end and can be connected with the conduit through a second opening in the first end, and the piston can be fixed with the drawer body by a stem that extends from a back wall of the drawer body through a second end of the cylinder opposite the first end.

The piston can cover at least one of the first opening and the second opening when the drawer body is in the closed position, and the piston can be spaced apart from the first opening and the second opening when the drawer body is in the opened position such that a portion of the fluid flow path extends through the first end of the cylinder between the first and second openings.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven comprising:

a cooking chamber;

a cabinet at least partially surrounding the cooking chamber;

a water reservoir having a reservoir inlet and a reservoir outlet, the oven being configured to extract water from the water reservoir via the reservoir outlet to supply steam to the cooking chamber;

a conduit defining a portion of a fluid flow path into the reservoir inlet; and a water fill assembly including:

a holder being fixedly coupled with the cabinet and having a receiver fixed with the holder; and a drawer body defining a water-receiving cavity, an opening to the water receiving cavity, and a fill outlet from the water-receiving cavity, the drawer body defining the fluid flow path in from the opening and out through the fill outlet and including a blocking element fixed with the drawer body and defined along a ledge extending vertically from a bottom surface of the drawer body within the water-receiving cavity, the drawer body being slideable with respect to the holder between an opened position, wherein the opening to the water-receiving cavity is exposed to an environment surrounding the oven and the blocking element is spaced from the receiver with the fluid flow path extending past the blocking element, and a closed position, wherein the drawer body is retracted into the holder and the blocking element is engaged with the receiver to close the fluid flow path between the opening of the drawer body and the conduit.

2. The oven of claim 1, wherein:

when the blocking element is spaced from the receiver the fluid flow path is open between the drawer body and the conduit to allow an inflow of water from the opening of the water-receiving cavity to the reservoir; and when the blocking element is engaged with the receiver to close the fluid flow path between the opening of the drawer body and the conduit a backflow of steam from the reservoir to the opening of the drawer body is obstructed.

3. The oven of claim 1, wherein the blocking element is rigidly fixed with the drawer body to move with the drawer body between the closed position and the opened position.

4. The oven of claim 1, further including a front face, wherein the drawer body has an outer surface that is generally coplanar with the front face of the oven when the drawer body is in a closed position.

5. The oven of claim 1, wherein the receiver is defined in a notch on an end of a flange that extends from an upper wall of the holder into the water-receiving cavity, the ledge moving into contact with the notch when the drawer body is in a closed position.

6. The oven of claim 5, wherein the ledge is spaced apart from the bottom surface of the water-receiving cavity such that the end of the flange aligns with the notch in a position spaced from the bottom surface of the water-receiving cavity to allow the flow path to extend between the end of the flange and the bottom surface of the water-receiving cavity when the drawer body is in the opened position.

7. The oven of claim 6, wherein the bottom surface of the water-receiving cavity is sloped downwardly away from the ledge to increase a distance between the bottom surface and the end of the flange when the drawer body is in the opened position compared to the closed position.

8. The oven of claim 5, wherein a back wall of the drawer body is positioned adjacent the flange when the drawer body is in the opened position.

9. An oven, comprising:

a cooking chamber;

a cabinet at least partially surrounding the cooking chamber;

a water reservoir having a reservoir inlet and a reservoir outlet, the oven being configured to extract water from the water reservoir via the reservoir outlet to supply steam to the cooking chamber;

a conduit defining a portion of a fluid flow path into the reservoir inlet; and a water fill assembly including:

a holder having a notch on an end of a flange fixed with the holder, the flange extending from an upper wall of the holder; and a drawer body defining a water-receiving cavity, an opening to the water-receiving cavity, and a fill outlet from the water-receiving cavity, the drawer body defining the fluid flow path in from the opening and out through the fill outlet and including a ledge extending vertically from a bottom surface of the drawer body within the water-receiving cavity, the drawer body being slideable with respect to the holder between an opened position, wherein the opening to the cavity is exposed to an environment surrounding the oven and the ledge is spaced from the notch, and a closed position, wherein the drawer body is retracted into the holder and the ledge is in contact with the notch to close the fluid flow path between the opening of the drawer body and the conduit.

10. The oven of claim 9, wherein the flange extends vertically into the water-receiving cavity such that the ledge moves into contact with the notch when the drawer body is in a closed position.

11. The oven of claim 10, wherein the ledge is spaced apart from the bottom surface of the water-receiving cavity such that the end of the flange aligns with the notch in a position spaced from the bottom surface of the water-receiving cavity to allow the flow path to extend between the end of the flange and the bottom surface of the water-receiving cavity when the drawer body is in the opened position.

* * * * *